US006564902B1

(12) United States Patent
Saberi

(10) Patent No.: US 6,564,902 B1
(45) Date of Patent: May 20, 2003

(54) DEVICE AND METHOD FOR A SOUND-ATTENUATING UNIT

(75) Inventor: Josef Saberi, Eindhoven (NL)

(73) Assignee: Volvo Personvagnar AB, Göteborg (SE)

( * ) Notice: Subject to any disclaimer, the term of this patent is extended or adjusted under 35 U.S.C. 154(b) by 0 days.

(21) Appl. No.: 09/570,500

(22) Filed: May 13, 2000

Related U.S. Application Data

(63) Continuation of application No. PCT/SE98/01968, filed on Oct. 30, 1998.

(30) Foreign Application Priority Data

Nov. 14, 1997 (SE) ..... 9704221

(51) Int. Cl.[7] ..... F01N 1/24
(52) U.S. Cl. ..... 181/237; 181/255
(58) Field of Search ..... 181/237, 241, 181/255, 249, 253, 236, 254

(56) References Cited

U.S. PATENT DOCUMENTS 2,072,372 A 3/1937 Kingsley
5,723,829 A * 3/1998 Inomata et al. ..... 181/254

FOREIGN PATENT DOCUMENTS

| | | |
|---|---|---|
| EP | 0733785 A2 | 9/1996 |
| EP | 0771939 A1 | 5/1997 |
| WO | 93/11347 | 6/1993 |

* cited by examiner

*Primary Examiner*—Khanh Dang
(74) *Attorney, Agent, or Firm*—Howrey Simon Arnold & White LLP

(57) ABSTRACT

A device for a sound-absorbing unit for reduction of sounds from a flowing gas stream, including a first flow path and a second flow path for said gas stream and a switch-over device for alternating guiding of the gas stream along the first flow path and the second flow path, respectively. A detection device for detection of the pressure of said gas stream, and that the switch-over device comprises an adjustable throttle for blocking of the first flow path when a pressure which is below a predetermined limit value is detected, wherein the gas stream is guided through said second flow path, and that the throttle is adapted to be opened if said limit value is exceeded, wherein the gas stream is guided along said first flow path. By means of the invention, an improved adjustable device is provided for mufflers for vehicles, said device providing an effective sound absorption, a small mounting volume and a low back pressure during high engine speeds.

11 Claims, 4 Drawing Sheets

DEVICE AND METHOD FOR A SOUND-ATTENUATING UNIT

RELATED PATENT APPLICATIONS

This is a continuation patent application of International Application Number PCT/SE98/01968 filed Oct. 30, 1998 and published in the English language under PCT Article 21(2), now abandoned, that designates the United States. The full disclosure of said application, in its entirety, is hereby expressly incorporated by reference into the present application.

BACKGROUND OF THE INVENTION

1. Technical Field

The present invention relates to a device for a sound-absorbing unit. The invention is particularly intended to be utilized in connection with a sound-absorbing unit in the form of a muffler used in an exhaust system of a motor vehicle. The invention also relates to a method for affecting absorption of sound incident to gas streams such as exhaust from combustion engines.

2. Background Information

Vehicles which are driven by means of an internal combustion engine normally also contain an exhaust system which is utilized in order to guide away the discharges of the engine exhaust gases that are generated during the combustion of motor fuel. In this connection, there is a general demand for guiding the exhaust gases away from the vehicle while assuring that a minimum of noise is generated from the exhaust gas stream.

Today's exhaust systems which are intended for use on, for example, passenger cars, comprise an exhaust pipe, at least one muffler and normally also a catalytic converter. Regarding the muffler, it is utilized to even out pulsations in the exhaust gas stream and, as a result, to make the exhaust gases as inaudible as possible. In this manner, the sound level of the exhaust gas stream can be lowered.

Apart from the requirement regarding a low sound level, it is also required in connection with today's vehicles that the exhaust system be designed to be of small size since the available mounting room on today's passenger vehicles is getting increasingly smaller.

In order to satisfy the requirement regarding the sound-absorbing capacity of a muffler in an exhaust system, it has been previously known to design the muffler in such a way that it can be switched between various configurations responsive to various conditions. In one case, a first condition may be characterized by low engine load. When this condition prevails, the exhaust gas stream can be guided along a certain flow path having a particularly satisfactory sound-absorbing capacity. This results in a low sound level in the exhaust system. This is particularly true when the vehicle is stationary and idling. When the first condition does not prevail, the exhaust gas stream can be guided along another flow path in the exhaust system. According to known technique, the exhaust gas stream can be guided between the different flow paths by means of an electromechanical or pneumatic regulator which is provided with an input signal from the engine. In this manner, by means of such a regulator, the gas stream can be guided between the different flow paths.

One essential drawback regarding these previously known arrangements in the relevant technical field is that there is a risk of too high of a back pressure occurring in the exhaust system in the event of a high engine load and engine speed. This may in turn result in reduced engine power, which of course is a drawback, particularly when such an operational drop occurs during high engine demand or speeds. An additional drawback is that the previously known systems require a relatively large mounting area, a condition that is particularly problematic in connection with today's passenger cars that are growing ever smaller.

Thus, there is a need for adjustable devices for sound-absorbing units which in particular provide effective sound absorption, a small mounting volume and a low back pressure during high engine speeds.

SUMMARY OF THE INVENTION

An object of the present invention is to provide an improved device for a sound absorbing unit, which in particular is intended for an exhaust system. Another object is to accommodate a method for quieting an exhaust gas stream of a motor vehicle, by which the above-mentioned problems are solved.

A muffler device according to the present invention comprises a sound-absorbing unit for the reduction of sounds from a flowing gas stream. The muffler comprises a first flow path and a second flow path for the gas stream and a switch-over device for alternatively guiding the gas stream along the two paths. The invention is characterized in that it has a detection device for detecting the pressure of the gas stream. The switch-over device comprises an adjustable throttle adapted to be configured between closed and open orientations that respectively (1) block the first flow path when a pressure is detected that is below a predetermined limit value and (2) allow the gas stream to flow through the first flow path when the pressure limit value is exceeded.

According to a preferred embodiment, the switch-over device comprises a valve device having at least one elastic diaphragm which is acted upon by the exhaust gas' pressure. Also, the second flow path is preferably constituted by a particular damping volume which is arranged concentrically in relation to the rest of the sound absorbing unit.

According to the invention, several advantages are achieved compared to previously known devices. First of all, it can be stated that the invention permits very effective sound absorption during low engine load, and a low fall of pressure during increasing engine load by switch-over to the above-mentioned first flow path. An additional advantage is that the invention causes a very low back pressure in the exhaust gas stream during conventional operational drops which were earlier identified with respect to high engine speeds, i.e. when the above-mentioned throttle is opened. Furthermore, due to the fact that the invention utilizes the existing pressure that prevails at the inlet to the sound-absorbing unit, excellent possibilities are provided for a simple and effective control of the position of the throttle. An additional advantage of the invention is that it requires a very small mounting space on the vehicle.

Advantageous embodiments of the invention will be apparent from the appended claims.

BRIEF DESCRIPTION OF THE DRAWINGS

The invention will now be described in greater detail in the following way, by example only, and with reference to the attached drawings, in which.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components or processes. Therefore, specific structural and functional details disclosed herein are not to be interpreted as limiting, but merely as a basis for the claims and as a representative basis for teaching one skilled in the art to variously employ the present invention.

Figure 1:
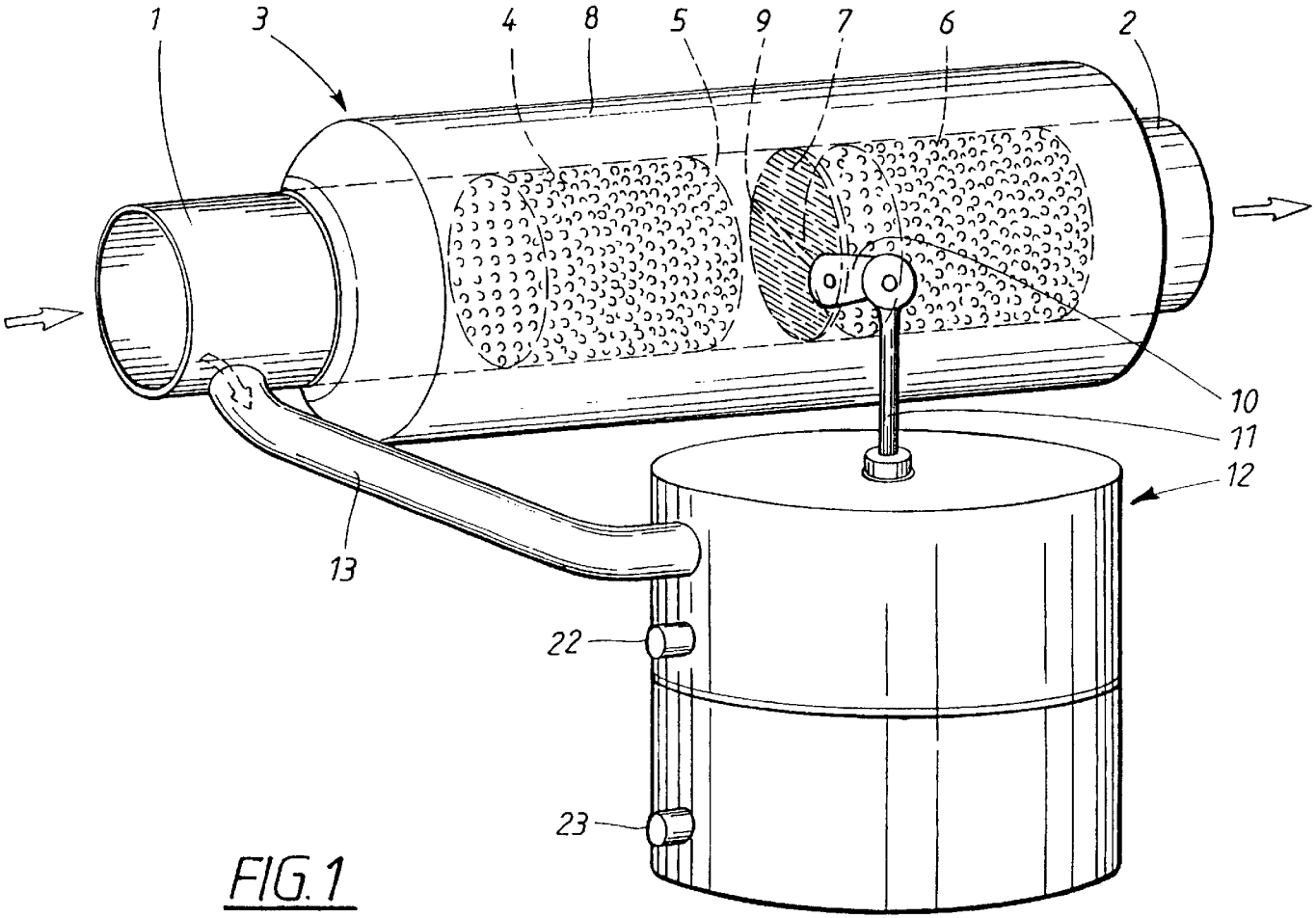
FIG. 1 shows a perspective view, shown in partial cutaway, of a sound absorbing or attenuating device constructed according to the present invention.

FIG. 1 shows a device configured in accordance with the present invention. The invention is in particular applicable in connection with mufflers for motor vehicles. Thus, according to a preferred embodiment, the invention is arranged so that it constitutes a part of an exhaust system for a motor vehicle. The device comprises a first connecting pipe 1, which is adapted to be connected to an exhaust pipe (not shown) for feed supply of an exhaust gas stream from an internal combustion engine (not shown) which is arranged in the vehicle. In this connection, the exhaust gases flow in the direction which is indicated by means of arrows in FIG. 1. Furthermore, the shown device comprises a second connecting pipe 2 which is adapted to be connected to an additional exhaust pipe (not shown) which is adapted for guiding the exhaust gas stream further out into the atmosphere. Thus, as regards the exhaust gas stream flow through the system, it is apparent that the first connecting pipe 1 is arranged upstream of the second connecting pipe 2.

Between the two connecting pipes 1, 2, a sound-absorbing unit 3 is arranged. As is apparent from FIG. 1, the sound-absorbing unit comprises a first perforated pipe section 4, which is connected to, and constitutes an extension of, the first connecting pipe 1. The first perforated pipe section 4 is substantially cylindrically shaped and is connected to an intermediate, unperforated pipe section 5, which in turn is connected to a second perforated pipe section 6 similar to the first perforated pipe section 4. Finally, the second perforated pipe section 6 is connected to the second connecting pipe 2.

As will be described in greater detail hereinbelow, the intermediate section 5 comprises, that is includes an adjustable throttle 7, preferably in the form of a circular disc. Furthermore, the pipe sections 4, 5, 6 are preferably shaped and dimensioned in a manner which is favorable as regards their sound-absorbing properties. For example, by choosing volume, cross section area and the like in a suitable way, either of the pipe sections 4, 5, 6 can be adjusted to function as a high pass filter, which enables damping of the sounds which are generated by the flowing exhaust gases. As a complement to such a design, each pipe section 4, 5, 6 may also include sound-absorbing materials, for instance, mineral wool and the like.

The perforated pipe sections 4, 6 are connected to a second damping volume 8 via their perforations, the second damping volume being substantially shaped as an cylindrical housing having a slightly larger diameter than the perforated sections 4, 6 and the intermediate section 5. The damping volume 8 is preferably arranged substantially concentrically in relation to the pipe sections 4, 5, 6 and thus surrounds the sections. The damping volume 8, which constitutes a part of the sound absorbing unit 3, is in conformance about the pipe sections 4, 5, 6 and is dimensioned in such a way that it provides a sound absorbing effect for flowing exhaust gases. As a complement to this, the damping volume 8 also can include sound-absorbing materials such as mineral wool.

According to the present invention, the exhaust gas stream from the engine can either be guided along a first flow path or along a second flow path depending upon whether certain predetermined motor conditions-prevail. More precisely, the conditions are characterized in that the engine is driven by a relatively low load and low engine speed and a relatively high load and high engine speed, respectively. In accordance with the invention, the conditions can be detected by means of detection of the prevailing pressure in the gas stream being conducted to the muffler 3. The first flow path is defined by the first perforated pipe section 4, the intermediate section 5, and the second perforated pipe section 6. According to what will be described in greater detail below, the exhaust gas stream is guided along this first flow path during a relatively high engine load and high engine speed. Alternatively, the second flow path is defined by the first perforated pipe section 4, the damping volume 8 and the second perforated section 6. The exhaust gas stream is guided along the second flow path during conditions of relatively low engine load and low engine speed.

In order to guide the exhaust gas stream along either of the two flow paths, the above-mentioned throttle 7 is utilized which constitutes a switch-over device for switching between the two above-mentioned configurations. To this end, the throttle 7 is suspended on a shaft 9 which in turn is pivotally suspended in the intermediate section 5. The shaft's 9 lengthwise extension is substantially perpendicular to the longitudinal direction of the intermediate section 5. By means of a lever arm 10, the shaft 9 can be influenced to rotate. The lever arm, in turn, is connected to a draw bar 11. The draw bar 11 constitutes a part of a particular valve device 12, which, according to this embodiment of the present invention, is of the diaphragm valve-type and which will be described in greater detail hereinbelow. A pressure line 13 is connected to the valve device 12 and by means of which pressure line exhaust gases are deflected under pressure from the first connecting pipe 1 and further to the valve device 12, which is indicated by means of a broken arrow in FIG. 1. By means of the valve device 12, the prevailing pressure level in the exhaust gas stream can be utilized for configuring the throttle 7.

Figure 2:
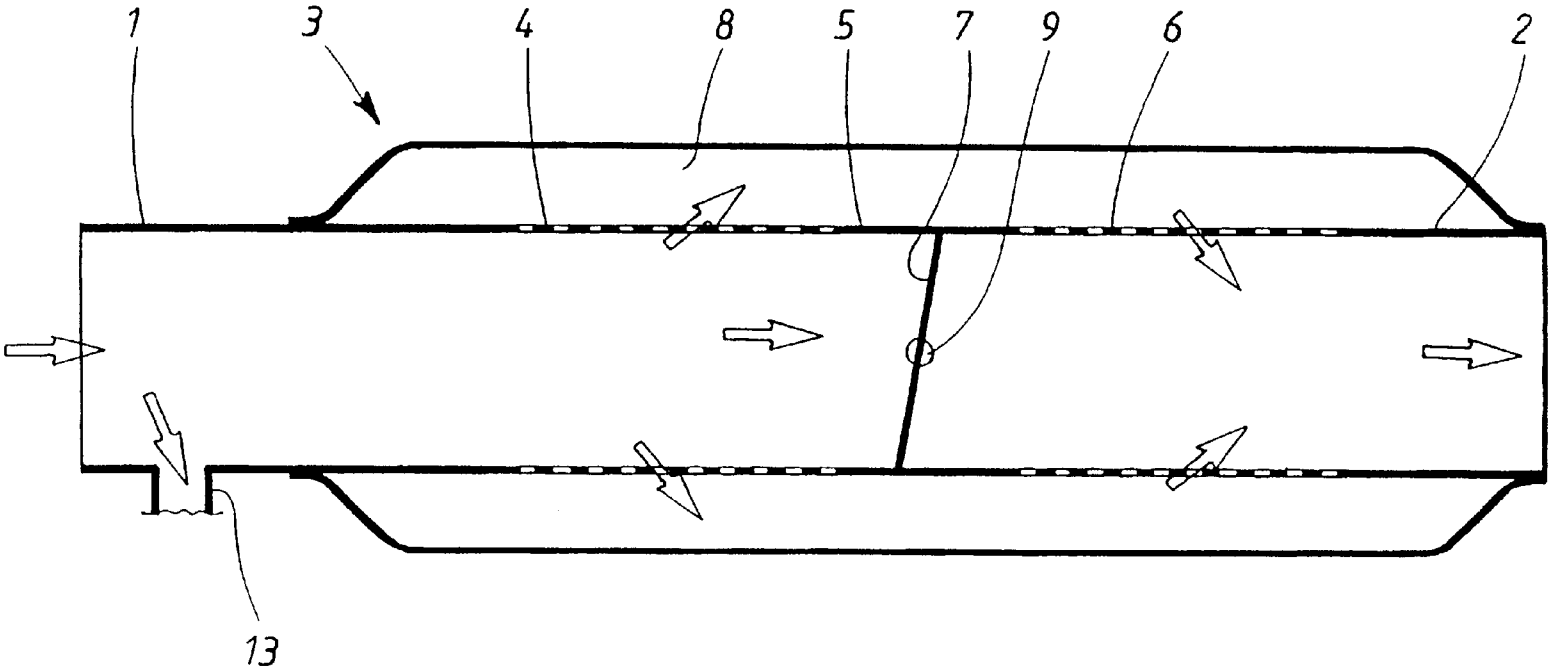
FIG. 2 shows a simplified, partial cutaway view of a sound absorbing device constructed according to the invention.

The design and function of the sound-absorbing unit 3 becomes more apparent and clear from reference to FIG. 2. This drawing shows a simplified cross-sectional view taken from the side. From this illustration, it is apparent that the throttle 7 can be set to a position in which the intermediate section 5 is blocked against the passage of the incident exhaust gas stream. In this configuration, the gas stream is forced, via the perforations in the first perforated section 4, into the surrounding damping volume 8. The gas stream is guided along the damping volume 8 and then back inwardly through the perforations in the second perforated section 6 toward the second connecting pipe 2. In the event of a condition which is characterized by a low load and low speed in the combustion engine, a condition that correspondingly produces a relatively low gas flow and pressure in the exhaust gas stream, the throttle 7 is set in the blocking position which is shown in FIG. 2. In the contrary case, the throttle 7 is configured to an open position responsive to high load and high speed conditions in the engine. This results in the gas stream following the first flow path that is defined by the perforated section 4, the intermediate section 5, the perforated section 4; in this configuration the gas stream essentially bypasses the damping volume 8.

The function of the valve device 12 will now be described with reference in particular to FIG. 3, which is a slightly simplified and at least partially cutaway view of the assembly of the present invention. By means of a two-way arrow, it is indicated in the drawing that the draw bar 11 is adapted in such a way that it reciprocates within, by being pushed up and down, an inside of a housing 14 that surrounds the rest of the valve device 12. The housing 14 is essentially designed as a cylindrical container and includes a rigid baffle 15 and two flexible diaphragms 16, 17. The diaphragms 16, 17 are made of elastic material, preferably rubber or other suitable material having similar performance characteristics.

The housing 14, the baffle 15 and the diaphragms 16, 17 jointly define four different chambers 18, 19, 20 and 21 within the housing 14. The first chamber 18 is defined by the housing 14 and the first diaphragm 16, and constitutes a chamber to which the pressure line 13 is connected. Thus, in this first chamber 18, a certain pressure prevails, the magnitude of which depends upon the gas flow and the pressure in the first connecting pipe 1 (see FIG. 1), and thus also upon the prevailing operating condition in the combustion engine.

The second chamber 19 is defined by the first diaphragm 16 and the baffle 15, and is in connection with the surrounding atmosphere via an opening 22. Thus, atmospheric pressure always prevails in the second chamber 19.

The third chamber 20 is defined by the baffle 15 and the second diaphragm 17, whereas the fourth chamber 21 is defined by the second chamber 17 and the inner bottom surface of the housing 14. The fourth chamber 21 is in connection with the surrounding atmosphere via an additional opening 23. Thus, atmospheric pressure always prevails in the fourth chamber 21.

Between the first diaphragm 16 and the baffle 15, a first spring 24 is arranged, which preferably is constituted by a coil spring. The spring 24 is adapted so that it exerts a force against the first diaphragm 16 causing a configuration as shown in FIG. 3. This condition corresponds to the draw bar 11 being in its top end, or raised position, which in turn corresponds to the throttle 7 being configured to its closed position.

Furthermore, the draw bar 11 has an extension that takes the form of a substantially cylindrical section 25 that extends inside the housing 14. More precisely, the cylinder 25 extends through a hole 26 in the upper side of the housing 12 and through a hole 27 in the first diaphragm 16. The cylinder 25 is fixedly connected to the first diaphragm 16 and by means of which the cylinder 25, and thus also the draw bar 11, is influenced to be transferred upwards or downwards in the event of a corresponding influence by a compressive force against the first diaphragm 16. Furthermore, the cylinder 25 is provided with at least one through hole 28 which provides a fluid connection between the inner part of the cylinder 25 and the first chamber 18.

The cylinder 25 has its extension through a hole 29 in the baffle 15 and through an additional hole 30 in the second diaphragm 17. By analogy with what has been stated above, the cylinder 25 is connected with the second diaphragm 17 so that the cylinder 25 (and thus also the draw bar 11) is influenced to be pushed upwards or downwards in the event of a corresponding influence on the second diaphragm 17.

Figure 3:
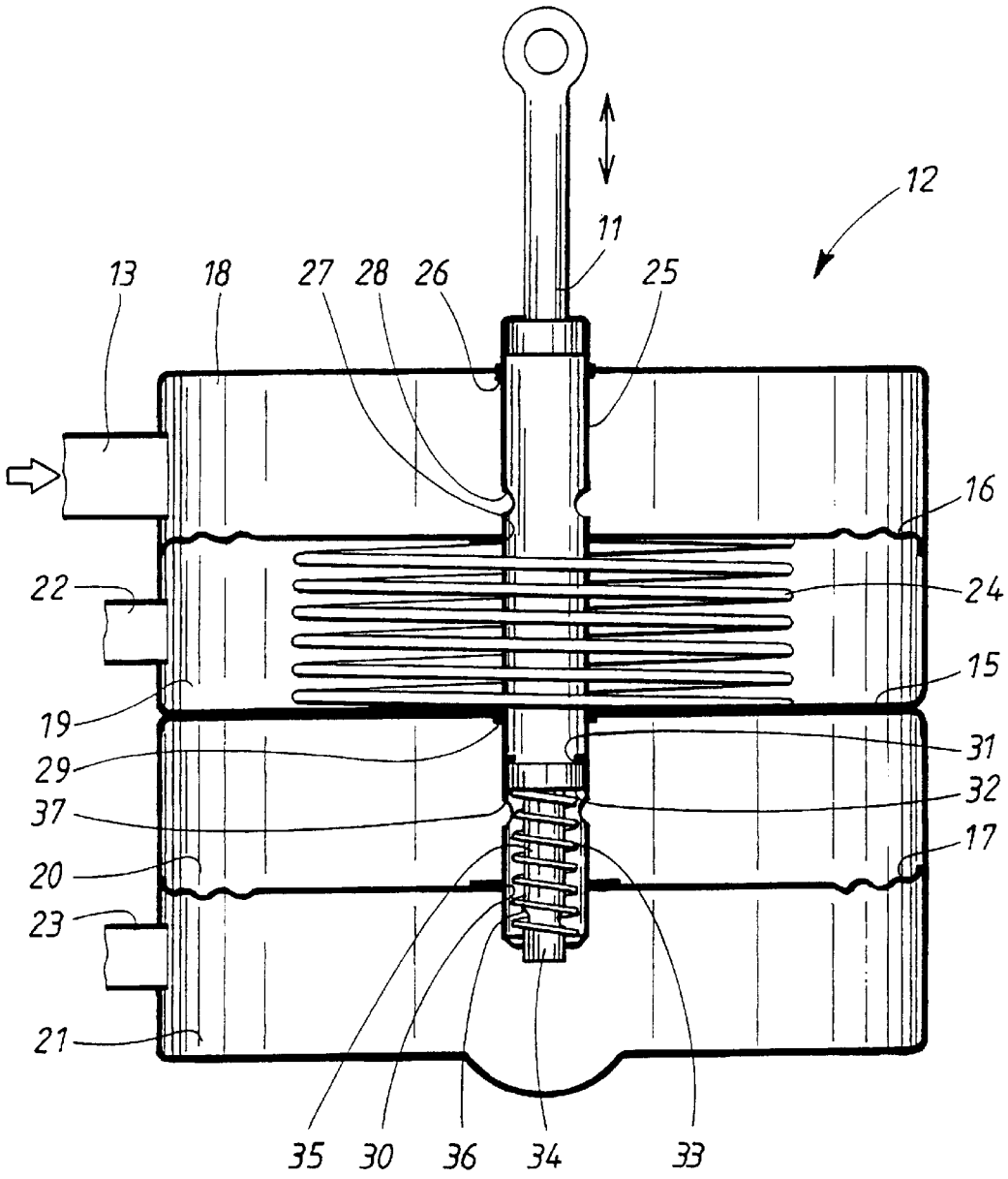
FIG. 3 shows a simplified partial cross-sectional and partial cutaway view of a sound absorbing device constructed according to the invention.

According to the illustration of FIG. 3, the lower end section of the cylinder 25, that is the end section of the cylinder 25 that faces away from the draw bar 11, is provided with an inner, circular projection or flange 31. This projection 31 is adapted to cooperate with an inner valve which comprises a piston 32 that is adapted for displacement along an inner part of the cylinder 25. For this reason, the outer dimensions of the piston 32 substantially correspond to the inner dimensions of the cylinder 25. Furthermore, the piston 32 is spring-loaded utilizing a second spring 33, preferably in the form of a coil spring. In this manner, the piston 32 can be acted upon by a spring force that biases the piston 32 into close contact with the projection 31. This is due to the fact that one of the end sections of the second spring 31 presses against the underside of the piston 32. The opposed end section of the second spring 33 is fixedly connected with a lower end section of the cylinder 25. The lower end section of the cylinder 25 terminates with an opening 34 against the fourth chamber 21. Furthermore, the piston 32 is provided with a cylindrical sleeve 35, which extends through the second spring 33 and through the opening 34. The sleeve 35 is provided with a through hole 36 which, in the condition which is shown in FIG. 3, together with the opening 34 and an additional hole 37 in the cylinder 25, defines a connection between the third chamber 20 and the fourth chamber 21.

If the upper side of the piston 32 is acted upon by a pressure of such magnitude that the spring force from the second spring 33 is exceeded, the piston 32 will be pressed down along the cylinder 25; that is, so that it is no longer in tight, close contact with the projection 31. This results in that the piston 32 and the sleeve 35, which is connected with the piston 32, being transferred downwards in relation to the cylinder 25. Finally, the piston 32 and the sleeve 35 will have been transferred sufficiently far down that the hole 36 in the sleeve 35 is positioned below the hole 34 in the end section of the cylinder 25. At the same time, the piston 32 will have been pressed so sufficiently far down that it is in level with the hole 37, or even further down. In this manner, the connection between the third chamber 20 and the fourth chamber 21 is blocked. Also, a connection is then established between the first chamber 18 and the third chamber 20. In this manner, a fluid connection is defined by the hole 28, the inner part of the cylinder 25 and the hole 37. In this condition, both diaphragms 16,17 are acted upon by the pressure that prevails in the pressure line 13.

The function of the invention will now be described in greater detail. In case of the combustion engine being operated with a relatively low load and at a relatively low speed, a relatively low gas flow prevails through the first connecting pipe 1. This also results in a relatively low pressure being experienced in the pressure line 13 and in the first chamber 18. In this regard, the first spring is selected to have a stiffness that, during this relatively low pressure condition is capable of holding the first diaphragm 16 in an essentially unaffected condition; that is, in the condition that is shown in FIG. 3. This condition causes a configuration in which the draw bar 11 is in a raised position which corresponds to the throttle 7 being in a closed position; that is, the throttle 7 blocks the intermediate section 5 against the passage of the gas stream. This, in turn, results in the gas stream being forced to pass along the flow path which includes the surrounding damping volume 8. In this manner, the sounds which are generated by the gas stream will be dampened due to the fact that the gas stream passes through the sound absorbing material in the damping volume 8. This functionality provides a very effective damping of exhaust sounds, which in particular can be utilized when the vehicle in question is stationary and the combustion engine is idling.

Concurrently with the increase of the engine load and the engine speed, an increasingly higher pressure will prevail in the first chamber 18 as is shown in FIG. 3. This also results in an increasingly higher pressure that acts upon the first diaphragm 16. When the pressure finally exceeds a predetermined limit value $P_0$, which corresponds to the spring force which is provided by the first spring 24, the first diaphragm 16 will start to be pressed in the direction towards the second chamber 19, which results in the draw bar 11 being pulled down as well. This causes the throttle 7 to start opening.

During the above-mentioned course of events, the second diaphragm 17 will also be acted upon by the exhaust gas pressure via the cylinder 25, which is due to the fact that these two components are fluidly connected with each other. Finally, if the pressure in the first chamber 18 subsequently raises sufficiently, the pressure against the upper side of the piston 32 will exceed a certain predetermined limit value $P_1$ which corresponds to the spring force which is provided by the second spring 33. This results in the piston 32 being displaced so that it no longer is in close contact with the projection 31, and so that it is gradually pressed down along the cylinder 25. When the piston 32 has been transferred so far that it is at least partly positioned below the opening 37 in the cylinder 25, a fluid connection is established between the first chamber 18 and the third chamber 20. This results in the prevailing exhaust gas pressure acting upon the second diaphragm 17 as well. In this manner, an equally large pressure acts upon both diaphragms 16, 17 which provides an increased force against the draw bar 11 and thus also an increase of the opening pace of the throttle 7. Finally, the throttle 7 will be completely open; that is, it will be configured so that it is essentially in parallel with the longitudinal direction of the intermediate section 5 which results in that the exhaust gas stream being permitted through the first flow path which is defined by the perforated sections 4, 6 and the intermediate section 5, essentially bypassing the damping volume 8. This operating condition results in the velocity of the exhaust gas through the muffler 3 being reduced. This also reduces the fall of pressure and noise caused by the gas flow. All in all, effective sound attenuation is accomplished while a very low back pressure is caused in the exhaust system when the throttle 7 is completely open.

When the pressure against the diaphragms 16, 17 decreases due to reduced engine load, the draw bar 11 will return to the raised position in which the throttle 7 is closed in response to the biasing force of the first spring 24. Also, in this manner, the piston 32 will return to its position in which it is in close contact with the projection 31.

Figure 4:
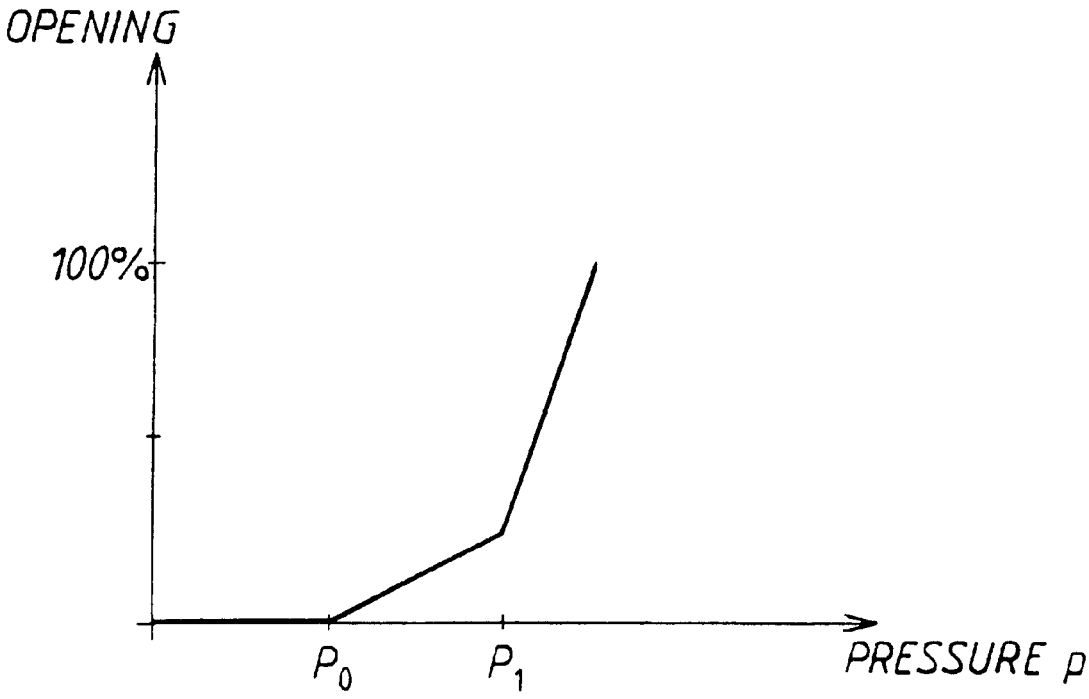
FIG. 4 shows a diagram that graphically illustrates the function of an adjustable throttle configured according to the present invention regarding exhaust gas pressure and throttle opening size.

The function of the invention will now be further described with reference to FIG. 4. This drawing shows a diagram which graphically illustrates the opening degree of the throttle 7 as a function of the pressure P that prevails in the pressure line 13 and which thus acts upon the valve device 12. As long as the pressure P is below the limit value $P_0$, the throttle 7, as mentioned above, will remain closed. When the pressure exceeds $P_0$, the spring force from the first spring 24 will be overcome, which results in the cylinder 25, as well as the draw bar 11, being pressed down. This results in the throttle 7 starting to open. As is apparent from the diagram, the opening pace during this phase is essentially constant. If the pressure is raised further and exceeds the second limit value, $P_1$, both diaphragms 16, 17 will be acted upon by the same pressure resulting in a faster opening pace for the throttle 7 in relation to the increase pace for the pressure. Finally, the throttle 7 will be in a completely open condition. To sum up, by means of the present invention, a smooth adjustment is provided for the transition between a completely closed throttle and a completely opened throttle, wherein a relatively low opening pace transforms into a relatively high opening pace when the limit value $P_1$ is exceeded.

According to the preferred embodiment of the invention, two diaphragms 16, 17 are utilized which can be acted upon according to the above-mentioned course of events. By means of suitable dimensioning of these diaphragms and the rest of the valve device 12, a back pressure is caused in the exhaust system which is essentially constant and independent of the engine speed. In this manner, the invention can be adapted to develop advantageous pressures within the exhaust system complimentary to the operating range of the engine and so that an optimal adjustment to the back pressure is obtained.

Thus, the valve device 12 constitutes a detection device for detecting the prevailing pressure in an incident gas stream and for guiding of the flow path of the gas stream depending upon whether the pressure exceeds a limit value $P_0$. According to the preferred and described embodiment, an additional condition can be detected as well; namely a condition in which the pressure exceeds a second limit value $P_1$. In this condition, both diaphragms 16, 17 will be acted upon by the gas pressure.

The invention is not limited to the embodiments which are described above and shown in the drawings, but may be varied freely within the scope of the appended claims. For example, the damping volume through which the gas stream is directed may alternatively be constituted by a side flow which runs along a particular line of pipe. Furthermore, the invention may in principle provide a satisfactory function as regards the function of the throttle in connection with a valve device which only utilizes one diaphragm.

The invention is not limited to be used in connection with exhaust systems. According to a possible variation of the invention, it may for example be utilized for damping of sounds on the intake side of the engine. In that case, the sound absorbing unit is arranged at the intake pipe of the engine. A pressure line is then provided as a connection between the inlet pipe and the valve device, according to the invention, by means of which the valve device detects the pressure in the inlet side. Furthermore, this alternative valve device, according to the invention, is provided with a reversed function, by means of which, concurrently with the building-up of a negative pressure on the intake side of the engine, the flow through the inlet pipe is guided via a particular damping volume during a low negative pressure and directly through the intake pipe, without passing through the damping volume, during a high negative pressure. This arrangement provides an effective damping of the intake sound of the engine.

According to a variation of the invention, the above-described valve device 12 may in principle be replaced by a pressure sensing sensor which is connected to a control unit, which in turn is adapted to control the throttle 7.

As an alternative to the above-described draw bar 11 and the lever arm 10, the throttle 7 may alternatively be opened and closed by means of an electric motor or other suitable substitute.

Finally, it is observed that the invention may be utilized for sound absorption in gas streams associated with other applications than exclusively with exhaust systems for motor vehicles.

Industrial Applicability. The present invention finds applicability in industries in which gas streams are desired to be quieted; and special applicability is found in the exhaust arts of the automotive industry.

What is claimed and desired to be secured by Letters Patent is as follows:

1. A device for a sound-absorbing unit for reduction of sounds from a flowing gas stream, comprising:

a first flow path and a second flow path for the gas stream, a switch-over device for alternating guiding of the gas stream along the first flow path and the second flow path, respectively, a detection device for detection of pressure of the gas stream, the switch-over device further comprising an adjustable throttle for blocking the first flow path when a pressure which is below a first predetermined limit value is detected, wherein the gas stream is guided through the second flow path and wherein the throttle is adapted to be opened if the first limit value is exceeded, wherein the gas stream is guided along the first flow path, the detection device further comprising a means for opening the throttle with a first opening pace when the first limit value is exceeded and with a second opening pace when a pressure exceeding a second predetermined limit value is detected.

2. The device according to claim 1, characterized in that the detection device comprises a valve device which is connected with the inlet to the sound-absorbing unit via a line and which is adapted for said control of the switch-over device.

3. The device according to claim 2, characterized in that said valve device comprises at least one elastic diaphragm which is adapted to be acted upon by said pressure, and that the diaphragm is connected with a connecting element for transmission of the movements of the diaphragm to said throttle.

4. The device according to claim 3, the valve device further comprising a second diaphragm connected with the connecting element, and an inner valve adapted to be opened in the vent of the pressure that exceeds the second predetermined limit value, whereby the line is put in connection with both diaphragms.

5. The device according to claim 4, characterized in that said inner valve comprises a spring-loaded piston which is adapted to be acted upon by said pressure and is arranged so that it cam be displaced in relation to said connecting element.

6. The device according to claim 1, characterized in that the second flow path at least partly is constituted by a side flow to the first flow path.

7. The device according to claim 6, characterized in that said side flow is constituted by a damping volume which is arranged essentially concentrically in relation to the first flow path.

8. The device according to claim 7, characterized in that the sound-absorbing element comprises two perforated, sound-absorbing pipe sections for connection of the gas stream to and from, respectively, said damping volume.

9. A method for a sound-absorbing unit for reduction of sounds from a flowing gas stream, the method comprising the steps of:

guiding the gas stream through a first flow path, alternatively, a second flow path, for the gas stream;

wherein switching over between the first flow path and the second flow path comprises detection of the pressure of the gas stream;

blocking the first flow path when pressure is below a first predetermined limit value and subsequently guiding the gas stream through the second flow path;

opening the first flow path when pressure exceeds the first limit value; and carrying out the opening of a throttle at a first opening pace when the first limit value is exceeded and at a second opening pace when a pressure exceeding a second predetermined limit value is detected.

10. The method according to claim 9, further comprising:

said detection of the pressure of the gas stream comprises at least one elastic diaphragm being acted upon; and the movements of the diaphragm are transmitted to a throttle that is adapted for said blocking and opening, respectively, of the first flow path.

11. The method according to claim 9, further comprising:

a first diaphragm being acted upon when the pressure exceeds the first limit value; and a second diaphragm being acted upon together with said first diaphragm when the pressure exceeds the second limit value.

* * * * *